US011527342B2

(12) United States Patent
Arai et al.

(10) Patent No.: US 11,527,342 B2
(45) Date of Patent: Dec. 13, 2022

(54) COIL COMPONENT AND ELECTRONIC DEVICE

(71) Applicant: TAIYO YUDEN CO., LTD., Tokyo (JP)

(72) Inventors: Takayuki Arai, Takasaki (JP); Naoya Terauchi, Takasaki (JP); Shuichi Machida, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 869 days.

(21) Appl. No.: 16/421,322

(22) Filed: May 23, 2019

(65) Prior Publication Data

US 2019/0362873 A1 Nov. 28, 2019

(30) Foreign Application Priority Data

May 28, 2018 (JP) ..... JP2018-101486

(51) Int. Cl.
*H01F 5/04* (2006.01)
*H01F 17/04* (2006.01)
(Continued)

(52) U.S. Cl.
CPC ..... *H01F 5/04* (2013.01); *H01F 17/04* (2013.01); *H01F 27/24* (2013.01); *H01F 27/292* (2013.01); *H01F 2017/048* (2013.01)

(58) Field of Classification Search
CPC . H01F 5/04; H01F 17/04; H01F 27/24; H01F 27/292
See application file for complete search history.

(56) References Cited

U.S. PATENT DOCUMENTS

2003/0206089 A1* 11/2003 Shikama ..... H01F 17/045 336/221
2011/0090665 A1* 4/2011 Korony ..... H05K 3/4611 29/829
(Continued)

FOREIGN PATENT DOCUMENTS

JP 2001102217 A 4/2001
JP 2008166455 A 7/2008
(Continued)

OTHER PUBLICATIONS

A Notice of Reasons for Refusal issued by the Japanese Patent Office, dated Dec. 7, 2021, for Japanese counterpart application No. 2018-101486. (4 pages).
(Continued)

*Primary Examiner* — Elvin G Enad
*Assistant Examiner* — Malcolm Barnes
(74) *Attorney, Agent, or Firm* — Law Office of Katsuhiro Arai

(57) ABSTRACT

In an exemplary embodiment, a coil component includes: a base part 10 containing a magnetic material; a flat coil 30 embedded in the base part 10, formed by a wound coil conductor 32 where an end part 34 and an end part 36 are located on the inner side and on the outer side of the windings, respectively; a lead conductor 50 and a lead conductor 52 connected to the end part 34 and the end part 36, respectively; an external electrode 60 and an external electrode 62 provided on the surface of the base part 10 and connected to the lead conductor 50 and the lead conductor 52, respectively. The lead conductor 50 is connected to the external electrode 60 in an area 42 on the inner side of the flat coil 30 as viewed from above in the axial direction of the flat coil 30.

13 Claims, 8 Drawing Sheets

(51) Int. Cl.
*H01F 27/24* (2006.01)
*H01F 27/29* (2006.01)

(56) References Cited

U.S. PATENT DOCUMENTS

| | | | | |
|---|---|---|---|---|
| 2013/0214888 | A1* | 8/2013 | Nogi | H01F 27/29<br>336/192 |
| 2017/0018351 | A1* | 1/2017 | Yatabe | H01F 27/2804 |
| 2017/0098997 | A1* | 4/2017 | Hamada | H01F 1/0306 |
| 2018/0075965 | A1* | 3/2018 | Yoshioka | H01F 27/2823 |
| 2019/0013141 | A1* | 1/2019 | Yoon | H01F 17/0006 |
| 2019/0074125 | A1* | 3/2019 | Yoshioka | H01F 41/063 |

FOREIGN PATENT DOCUMENTS

| | | | |
|---|---|---|---|
| JP | 2017069523 | A | 4/2017 |
| JP | 2017076700 | A | 4/2017 |
| JP | 2017199718 | A | 11/2017 |
| JP | 2018046051 | A | 3/2018 |

OTHER PUBLICATIONS

A Decision of Refusal issued by the Japanese Patent Office, dated Jun. 21, 2022, for Japanese counterpart application No. 2018-101486. (3 pages).

* cited by examiner

COIL COMPONENT AND ELECTRONIC DEVICE

CROSS-REFERENCE TO RELATED APPLICATIONS

The present application claims priority to Japanese Patent Application No. 2018-101486, filed May 28, 2018, the disclosure of which is incorporated herein by reference in its entirety including any and all particular combinations of the features disclosed therein.

BACKGROUND

Field of the Invention

The present invention relates to a coil component, and an electronic device.

Description of the Related Art

As the demand for thinner coil components rises, coil components are used in high frequency bands (such as 10 MHz and higher), allowing the coil components to have lower inductances. As a result, coil components that use a flat coil constituted by a single layer of a spirally-wound coil conductor, have been in use in recent years. A flat coil constituted by a spirally-wound coil conductor is such that one end part is positioned on the inner side of the flat coil, while the other end part is positioned on the outer side of the flat coil. Accordingly, constitutions are known, wherein a lead conductor connected to, of the two end parts of a flat coil, the end part positioned on the inner side of the flat coil, is led out from the inner side of the flat coil to the outer side of the flat coil and then connected to an external electrode (refer to Patent Literature 1, for example).

BACKGROUND ART LITERATURES

[Patent Literature 1] Japanese Patent Laid-open 2001-102217

SUMMARY

When a coil component is used in a high frequency band, a greater requirement is put on reducing loss. The higher the frequency at which the coil component is used, the higher the speed becomes at which magnetic flux transmitting through the coil conductor and lead conductor changes, and this increases loss due to eddy current that generates inside the conductor.

The present invention was made in light of the aforementioned problems, and its object is to suppress the increase in loss inside the conductor.

The present invention represents a coil component comprising: a base part containing a magnetic material and having insulating property; a flat coil embedded in the base part, formed by a wound coil conductor where a first end part on one side is located on the inner side of the windings, and a second end part on the other side is located on the outer side of the windings; a first lead conductor connected to the first end part of the flat coil; a second lead conductor connected to the second end part of the flat coil; a first external electrode provided on the surface of the base part and connected to the first lead conductor; and a second external electrode provided on the surface of the base part and connected to the second lead conductor; wherein, the first lead conductor is connected to the first external electrode in an area on the inner side of the flat coil when the base part and the flat coil are viewed from above in the direction of a coil axis of the flat coil The aforementioned constitution may be such that the first lead conductor is connected from the first end part of the flat coil to the first external electrode, along a straight line.

The aforementioned constitution may be such that the first lead conductor is parallel with the coil axis.

The aforementioned constitution may be such that the first lead conductor overlaps the coil conductor when the base part and the flat coil are viewed from above in the direction of the coil axis.

The aforementioned constitution may be such that the cross-sections of the first lead conductor and the second lead conductor, in the direction perpendicular to the coil axis, have a circular shape.

The aforementioned constitution may be such that: the first lead conductor connects to the first external electrode provided on a first face, among all surfaces, of the base part; the second lead conductor connects to the second external electrode provided on the first face of the base part; and the first external electrode and the second external electrode are not provided on a second face, on the opposite side of the first face, of the base part.

The aforementioned constitution may be such that the first external electrode and the second external electrode are provided only on the first face, among all surfaces, of the base part.

The aforementioned constitution may be such that: the first external electrode is provided in a manner extending from a first face among all surfaces, via a third face that connects to the first face and a second face on the opposite side of the first face, to the second face, of the base part; and the second external electrode is provided in a manner extending from the first face, via a fourth face that connects to the first face and the second face, to the second face, of the base part.

The aforementioned constitution may be such that it further comprises: a third lead conductor connected to the first end part of the flat coil; a fourth lead conductor connected to the second end part of the flat coil; a third external electrode provided on the surface of the base part and connected to the third lead conductor; and a fourth external electrode provided on the surface of the base part and connected to the fourth lead conductor; wherein, the first lead conductor is connected to the first external electrode provided on a first face, among all surfaces, of the base part; the second lead conductor is connected to the second external electrode provided on the first face of the base part; the third lead conductor is connected to the third external electrode provided on a second face, on the opposite side of the first face, of the base part, in an area on the inner side of the flat coil, when the base part and the flat coil are viewed from above in the direction of the coil axis; and the fourth lead conductor is connected to the fourth external electrode provided on the second face of the base part.

The aforementioned constitution may be such that: the first external electrode and the third external electrode are connected on a third face that connects to the first face and the second face of the base part; and the second external electrode and the fourth external electrode are connected on a fourth face that connects to the first face and the second face of the base part.

The aforementioned constitution may be such that: the first lead conductor is connected to the first external electrode provided on a first face, among all surfaces, of the base part; the second lead conductor is connected to the second external electrode provided on the first face of the base part; end parts of the first lead conductor and the second lead conductor project from the first face of the base part; and the first external electrode and the second external electrode cover the end parts of the first lead conductor and the second lead conductor to form dome-shaped projections.

The aforementioned constitution may be such that the height of the coil component is 0.6 mm or smaller.

The present invention represents an electronic device comprising: the aforementioned coil component; and a circuit board which the coil component is mounted on or embedded in.

According to the present invention, the increase in loss inside the conductor can be suppressed.

BRIEF DESCRIPTION OF THE DRAWINGS

(FIG. 2C shows a closed dotted figure line 43 drawn to define an area 42), while

FIG. 3A is a cross-sectional view A-A in FIG. 1, while

FIG. 4A is a perspective oblique view of the coil component pertaining to a comparative example, while

DESCRIPTION OF THE SYMBOLS

Figure 1:
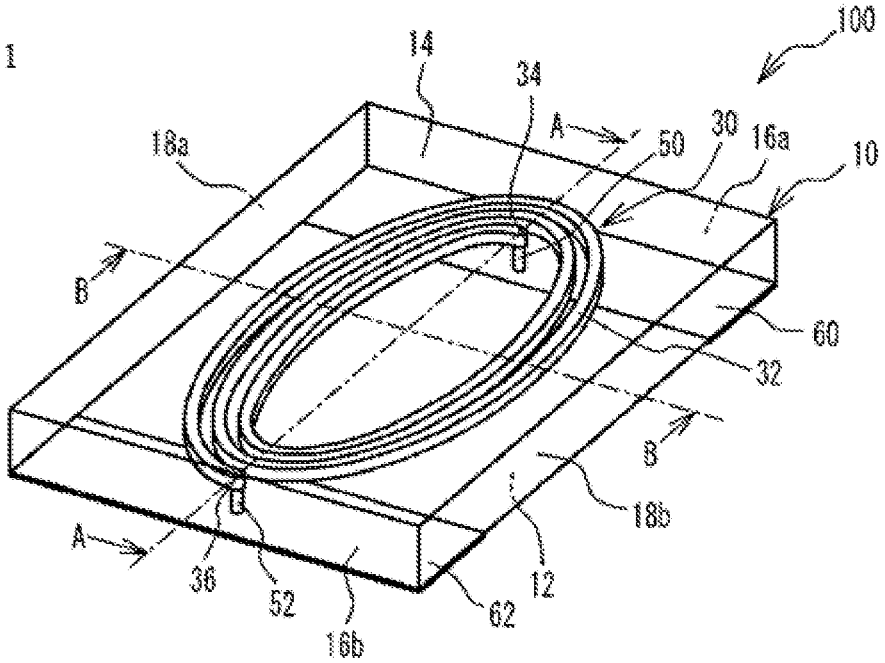
FIG. 1 is a perspective oblique view of the coil component pertaining to Example 1.

10 Base part
12 Bottom face
14 Top face
16*a*, 16*b* End face
18*a*, 18*b* Side face
20 Center line
22 Center
30 Flat coil
32 Coil conductor
33 Outermost periphery part
34, 36 End part
38 Coil axis
40, 42 Area
50, 51, 52, 54, 56 Lead conductor
60, 62, 64, 66 External electrode
65, 67 Face
68, 70 Projection
80 Board
90 Circuit board
92 Land pattern
94 Solder
100, 110, 120, 130 Coil component
200 Coil component
300 Coil component
400 Coil component
500 Electronic device
1000 Coil component

DETAILED DESCRIPTION OF EMBODIMENTS

Examples of the present invention are explained below by referring to the drawings.

Example 1

Figure 2A:
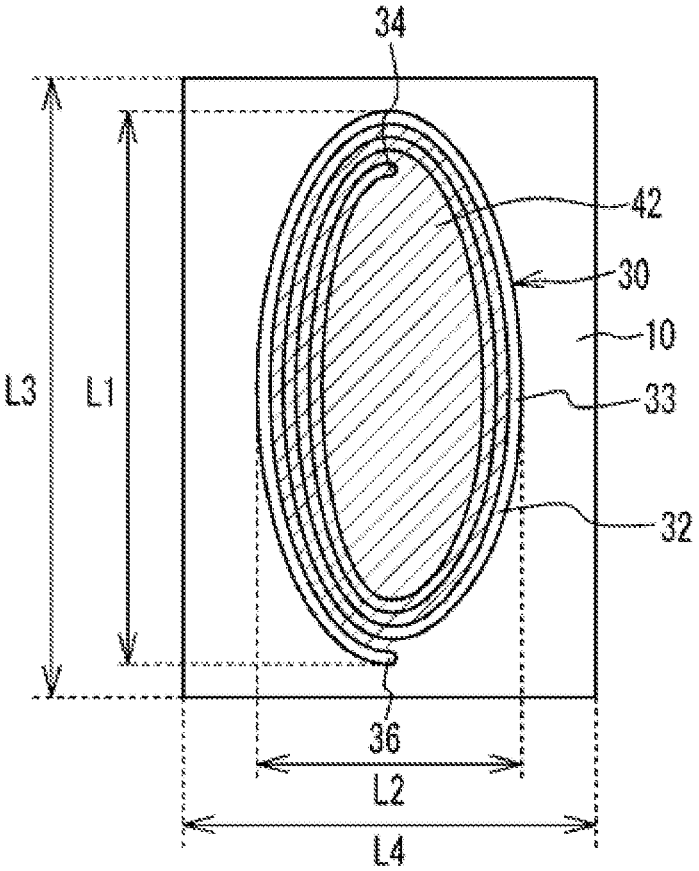
FIG. 2A is a perspective top view
Figure 2B:
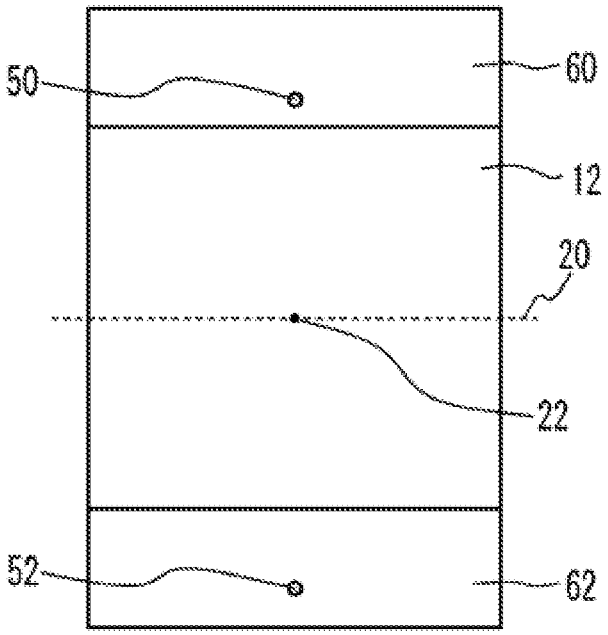
FIG. 2B is a bottom view, of the coil component pertaining to Example 1.
Figure 3A:
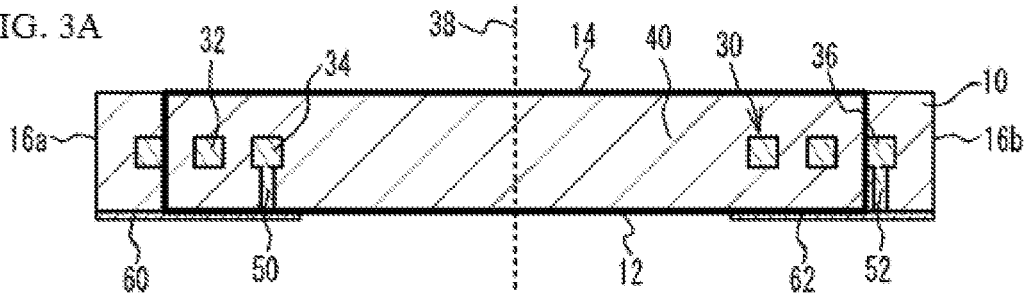
Figure 3B:
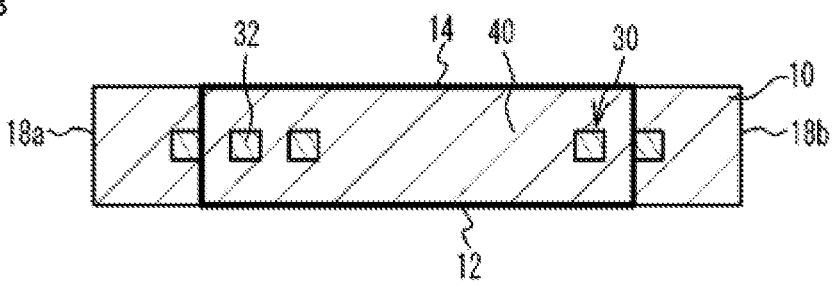
FIG. 3B is a cross-sectional view B-B in FIG. 1.

FIG. 1 is a perspective oblique view of a coil component pertaining to Example 1. FIG. 2A is a perspective top view, while FIG. 2B is a bottom view, of the coil component pertaining to Example 1. It should be noted that external electrodes are not illustrated in FIG. 2A, while the external electrodes, etc., are made transparent to illustrate a cross-section of the lead conductors in FIG. 2B. FIG. 3A is a cross-sectional view along A-A in FIG. 1, while FIG. 3B is a cross-sectional view along B-B in FIG. 1. As shown in FIG. 1, FIG. 2A, FIG. 2B, FIG. 3A, and FIG. 3B, a coil component 100 in Example 1 has a base part 10, a flat coil 30 embedded in the base part 10, lead conductors 50 and 52 led out from the end parts of the flat coil 30, and external electrodes 60 and 62 provided on the surface of the base part 10.

The base part 10 is shaped as a rectangular solid having a bottom face 12, a top face 14, a pair of end faces 16*a* and 16*b*, and a pair of side faces 18*a* and 18*b*. The bottom face 12 is the mounting face, while the top face 14 is a face on the opposite side of the bottom face 12. The end faces 16*a* and 16*b* are faces connected to the short sides of the bottom face 12 and the top face 14, while the side faces 18*a* and 18*b* are faces connected to the long sides of the bottom face 12 and the top face 14. It should be noted that the shape of the base part 10 is not limited to a perfect rectangular solid; instead, its vertices may be rounded, ridges (boundaries between faces) may be rounded, or faces may be curved, for example. In other words, "shaped as a rectangular solid" includes having these shapes.

The base part 10 has insulating property and is formed by a material that contains magnetic metal grains, ferrite grains, or other magnetic grains. The base part 10 is formed by a material in which magnetic grains are contained as a primary component, for example. "Contained as a primary component" means magnetic grains are contained by more than 50 percent by weight, 70 percent by weight or more, or 80 percent by weight or more, for example. The base part 10 may be formed by a resin that contains magnetic grains, or it may be formed by magnetic grains of which surfaces are insulation-coated. For the magnetic metal grains, FeSi-type, FeSiCr-type, FeSiAl-type, FeSiCrAl-type, Fe, Ni, or other magnetic metals, crystalline magnetic metals, non-crystalline magnetic metals, or nanocrystalline magnetic metals are used, for example. For the ferrite grains, NiZn-type ferrites, MnZn-type ferrites, or other ferrites are used, for example. For the resins, polyimide resins, phenolic resins, or other thermosetting resins may be used, or polyethylene resins, polyamide resins, or other thermosetting resins may be used, for example. For the insulating films to coat the surfaces of magnetic grains with, silicone oxide films and other inorganic insulating films may be used, for example.

The flat coil 30 is formed by a single layer of a spirally-wound coil conductor 32, where an end part 34 on one side of the coil conductor 32 is provided on the inner side of the windings, and an end part 36 on the other side is provided on the outer side of the windings, and it is also called "flat spiral coil." The end parts 34 and 36 may be positioned along a straight line that runs through the center of the flat coil 30 in top view and roughly in parallel with the long sides of the bottom face 12 and the top face 14, or one or both of the end parts 34 and 36 may deviate from such straight line. The coil conductor 32 is formed by copper, aluminum, nickel, silver, platinum, palladium, or other metal material or an alloyed material containing the foregoing, for example, and an insulating film may be provided on the conductor surface. The cross-section shape of the coil conductor 32 is a rectangle, for example, but it may also be a trapezoid, semi-ellipse constituted by straight lines and curved lines, or the like. The flat coil 30 has a coil axis 38 that crosses at right angles with a plane specified by the windings of the coil conductor 32. The bottom face 12 and the top face 14 of the base part 10 represent planes that cross roughly at right angles with the coil axis 38, while the end faces 16*a* and 16*b* and the side faces 18*a* and 18*b* of the base part 10 represent planes that are roughly in parallel with the coil axis 38. The coil conductor 32 has a spacing along each winding. This spacing may be air, the insulating film on the coil conductor 32, or other insulating material, so long as each winding is insulated.

The flat coil 30 is shaped as an ellipse with the coil conductor 32 being wound elliptically, for example; however, it may also be shaped as a circle with the coil conductor 32 being wound circularly, or a rectangle with the coil conductor 32 being wound rectangularly, or a so-called oval shape with the coil conductor 32 being wound in a manner combining the foregoing. Here, the shape of the flat coil 30, or specifically the wound shape of the coil conductor 32, is expressed as an ellipse, circle, rectangle, or oval by assuming that the conductor constituting the outermost periphery part of the coil conductor 32 forms a closed figure. The shape of the flat coil 30, or specifically the wound shape of the coil conductor 32, may also be expressed in the same way hereinafter. Also, the flat coil 30 is shaped as an ellipse when the ratio of a short axis length L2, to a long axis length L1, of the flat coil 30 (L2/L1) is 0.9 or smaller, while the flat coil 30 is shaped as a circle when the ratio is greater than 0.9. Also, preferably when a long direction length and a short direction length of the base part 10 are given by L3 and L4, respectively, the ratio of the long axis length L1 and the short axis length L2 of the flat coil 30 is roughly the same as the ratio of the long direction length L3 and the short direction length L4 of the base part 10 (L1:L2≈L3:L4). The coil axis 38 is defined as an axis that perpendicularly runs through the center of the wound shape of the coil conductor 32, when the conductor constituting the outermost periphery part of the coil conductor 32 is assumed to form a closed shape. If the wound shape of the coil conductor 32 is an ellipse, the center of the wound shape of the coil conductor 32 becomes a point of intersection between the long axis and the short axis; if the wound shape of the coil conductor 32 is a rectangle, the center of the wound shape of the coil conductor 32 becomes a point of intersection between the diagonal lines; if the wound shape of the coil conductor 32 is an oval, the center of the wound shape of the coil conductor 32 becomes a midpoint that equally divides the axis of symmetry into two.

Because the flat coil 30 has a so-called single-layer, spirally-wound shape where the coil conductor 32 does not overlap in the direction of the coil axis 38, the coil component 100 can be made thinner. For example, the height of the coil component 100 may be set to 0.6 mm or smaller, 0.4 mm or smaller, or 0.2 mm or smaller. Examples of the size (length×width×height) of the coil component 100 include 0.2 mm×0.1 mm×0.1 mm, 0.3 mm×0.2 mm×0.1 mm, 0.3 mm×0.2 mm×0.2 mm, 0.4 mm×0.2 mm×0.2 mm, 0.6 mm×0.3 mm×0.3 mm, 1.0 mm×0.5 mm×0.3 mm, 1.6 mm×0.8 mm×0.3 mm, 1.6 mm×0.8 mm×0.4 mm, 1.6 mm×0.8 mm×0.5 mm, 1.6 mm×1.0 mm×0.3 mm, 1.6 mm×1.0 mm×0.4 mm, 1.6 mm×1.0 mm×0.5 mm, 1.6 mm×1.2 mm×0.3 mm, 1.6 mm×1.2 mm×0.4 mm, 1.6 mm×1.2 mm×0.5 mm, 2.0 mm×1.2 mm×0.3 mm, 2.0 mm×1.2 mm×0.4 mm, 2.0 mm×1.2 mm×0.5 mm, 2.0 mm×1.2 mm×0.6 mm, 2.0 mm×1.6 mm×0.3 mm, and 2.0 mm×1.6 mm×0.5 mm, and the like.

The external electrodes 60 and 62 are external terminals used for surface mounting, and positioned in a manner partially overlapping the end parts 34, 36 of the coil conductor 32 when viewed from above in the direction of the coil axis 38. The external electrode 60 is provided on the bottom face 12 of the base part 10 at a position closer to the end face 16*a*. The external electrode 62 is provided on the bottom face 12 of the base part 10 at a position closer to the end face 16*b*. The external electrodes 60 and 62 are provided only on the bottom face 12 among all surfaces, and not provided on the top face 14, the end faces 16*a* and 16*b*, or the side faces 18*a* and 18*b*, of the base part 10. In other words, each of the external electrodes 60 and 62 is a one-face electrode provided only on one face, among all surfaces, of the base part 10. The external electrodes 60 and 62 are provided symmetrically to a center line 20 between the end faces 16*a* and 16*b* of the base part 10, for example. The external electrodes 60 and 62 may also be provided symmetrically to a center 22 of the bottom face 12 of the base part 10, for example. As the external electrodes 60 and 62 are provided symmetrically to the center line 20 and/or the center 22, the coil component 100 can be mounted on a circuit board, etc., in a well-balanced manner.

Each of the external electrodes 60 and 62 has a multi-layer structure having, for example, a bottom layer formed by copper, aluminum, nickel, silver, platinum, palladium, or other metal material, or an alloyed material containing the foregoing, a middle layer formed by silver or a conductive resin containing silver, and a top layer being a nickel, tin or copper plated layer. It should be noted that the layer structure of the external electrodes 60 and 62 is not limited to the one illustrated above, and may be such that intermediate layers are provided between the respective layers, a topmost layer is provided on top of the top layer, or the like.

Figure 2C:
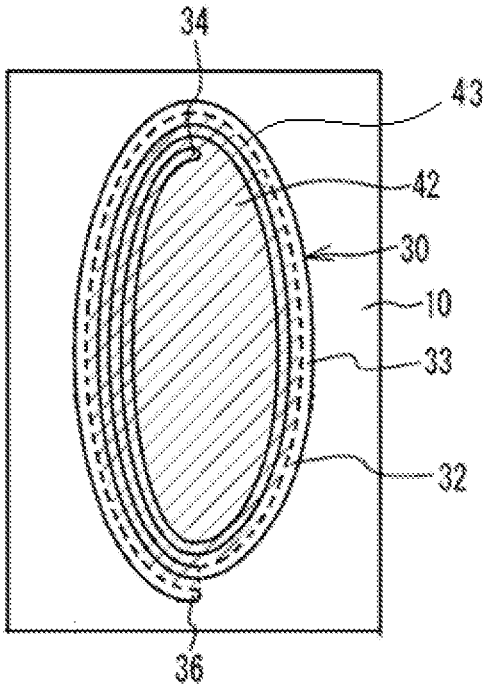

Here, when the flat coil 30 is viewed from above in the direction of the coil axis 38, an area, which is delineated or surrounded by a closed figure line drawn in a manner that a circumferential length along an outermost periphery part 33 of the coil conductor 32 is shortest, is referred to as an area 42 (shaded part surrounded by a closed dotted figure line 43 in FIG. 2A and FIG. 2C). When the flat coil 30 is viewed from above in the direction of the coil axis 38, the lead conductor 50 is present only inside the area 42 and connecting the end part 34 of the flat coil 30 and the external electrode 60 provided on the bottom face 12 of the base part 10. In other words, when an area between the bottom face 12 and the top face 14 of the base part 10 (inclusive of the bottom face 12 and the top face 14), a transverse section of which corresponds to the area 42 (in other words, the area between the bottom face 12 and the top face 14 of the base part 10, which sandwich the area 42), is referred to as an area 40 (the area inside the bold lines in FIG. 3A and FIG. 3B), the lead conductor 50 is present only inside the area 40 (inclusive of the bottom face 12 and the top face 14) and connecting the end part 34 of the flat coil 30 and the external electrode 60 provided on the bottom face 12 of the base part 10.

The lead conductor 50 may connect the end part 34 of the flat coil 30 and the external electrode 60 provided on the bottom face 12 of the base part 10, along a straight line. This way, the length of the lead conductor 50 becomes shorter, so the electrical resistance can be reduced. Also, the lead conductor 50 may connect the end part 34 of the flat coil 30 and the external electrode 60 provided on the bottom face 12 of the base part 10, in parallel with the coil axis 38. This way, the length of the lead conductor 50 becomes even shorter, so the electrical resistance can be reduced further and the below-mentioned impact of eddy current suppressed effectively. It should be noted that, "in parallel with the coil axis 38" means both ends of the lead conductor 50 are overlapping when viewed from above in the direction of the coil axis 38. The shortest length can be achieved when each end part is allowed to overlap by at least a half. Also, the aforementioned "in parallel with the coil axis 38" does not only mean "parallel" in the strict sense, but also accommodates a slight inclination and/or height gap, etc., equivalent to a manufacturing error. Also, the lead conductor 50 may be provided in a manner overlapping the coil conductor 32 when viewed from above in the direction of the coil axis 38. In other words, the lead conductor 50 may be placed in a manner fitting entirely inside the width of the coil conductor 32. This ensures good connection stability between the lead conductor 50 and the coil conductor 32, allowing the connection resistance to remain constant regardless of any position deviation of the connection part.

The lead conductor 52 may connect the end part 36 of the flat coil 30 and the external electrode 62 provided on the bottom face 12 of the base part 10, along a straight line. This way, the electrical resistance of the lead conductor 52 can be reduced. The lead conductor 52 may also connect the end part 36 of the flat coil 30 and the external electrode 62 provided on the bottom face 12 of the base part 10, in parallel with the coil axis 38. This way, the electrical resistance of the lead conductor 52 can be reduced further. Also, the lead conductor 52 may be connected to the external electrode 62 on the end face 16*b* of the base part 10 based on any general structure.

The lead conductors 50 and 52 are formed by copper, aluminum, nickel, silver, platinum, palladium, or other metal material or an alloyed material containing the foregoing, for example. The lead conductors 50 and 52 may be formed by the same material as the coil conductor 32, or they may be formed by a different material. The cross-section shapes of the lead conductors 50 and 52 in the direction perpendicular to the coil axis 38 are a circle, for example. This way, magnetic flux transmitting through the lead conductors 50 and 52 can be kept roughly constant, even when the coil conductor 32 is wound by an arbitrarily set number of times, and consequently the impact of loss can be kept constant. The diameters of the lead conductors 50 and 52 are approx. 50 μm to 300 μm, for example. It should be noted that the cross-section shapes of the lead conductors 50 and 52 in the direction perpendicular to the coil axis 38, if not a circle, may be an ellipse, rectangle, etc., for example.

Now, how the coil component 100 in Example 1 is manufactured, is explained. The coil component 100 is formed through steps including those where multiple green sheets (insulating sheets) are stacked. A green sheet is an insulating structural precursor to the base part 10, and is formed by, for example, applying a resin material containing magnetic grains onto a film using the doctor blade method or printing method.

First, multiple green sheets are prepared. Some of these multiple green sheets are lasered, etched, or otherwise processed to form through holes at specified positions. Next, on some green sheets in which through holes have been formed, a conductive material is applied using the printing method, for example, to form precursors to the coil conductor 32 and the lead conductors 50 and 52 that form the flat coil 30. Also, on other green sheets in which through holes have been formed, a conductive material is applied using the printing method, for example, to form precursors to the lead conductors 50 and 52. When sintered, these precursors become the coil conductor 32 and the lead conductors 50 and 52.

Next, the multiple green sheets are stacked in a specified order, and a pressure is applied in the stacking direction to pressure-bond the multiple green sheets. Then, the pressure-bonded green sheets are cut to individual chips using a dicer, lever cutter, etc., after which the chips are sintered at a specified temperature. As a result of this sintering, the base part 10 is formed in which the flat coil 30 constituted by the coil conductor 32, and the lead conductors 50 and 52, are provided. The external electrodes 60 and 62 are formed by paste printing, plating, sputtering, or other method used in thin-film processes.

Figure 4A:
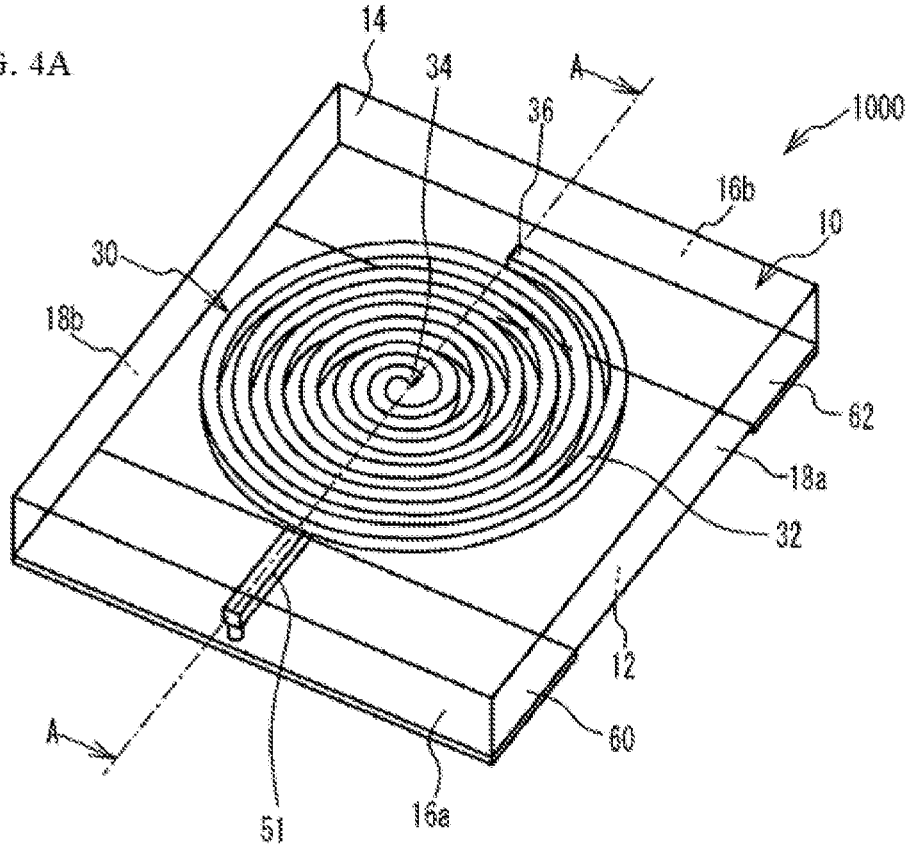
Figure 4B:
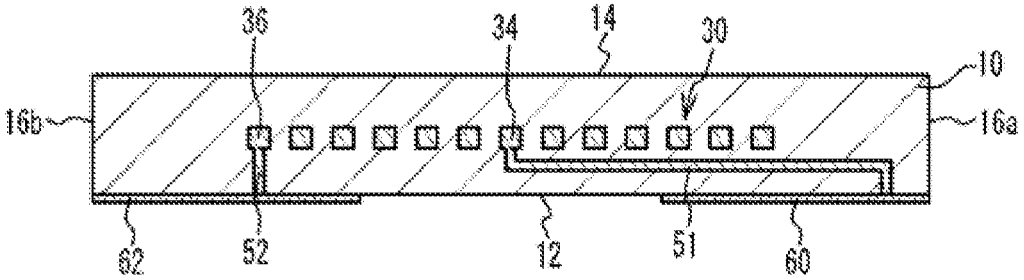
FIG. 4B is a cross-sectional view A-A in FIG. 4A.

Next, the coil component in a comparative example is explained. FIG. 4A is a perspective oblique view of the coil component pertaining to the comparative example, while FIG. 4B is a cross-sectional view along A-A in FIG. 4A. As shown in FIG. 4A and FIG. 4B, the coil component 1000 in the comparative example is configured so that the lead conductor 52 connected to, of the two end parts 34 and 36 of the flat coil 30, the end part 36 positioned on the outer side of the flat coil 30, connects the end part 36 of the flat coil 30 and the external electrode 62 provided on the bottom face 12 of the base part 10, along a straight line, just like in Example 1. On the other hand, the lead conductor 51 connected to the end part 34 positioned on the inner side of the flat coil 30 is led out from the end part 34 of the flat coil 30 toward the bottom face 12 of the base part 10, and then bent and led out from the inner side, toward the outer side, of the flat coil 30. Once it is led out toward the outer side of the flat coil 30, the lead conductor 51 is again bent and led out toward the bottom face 12 of the base part 10, and then connected to the external electrode 60 on the bottom face 12 of the base part 10. The remaining constitutions are the same as those in Example 1 and therefore not explained.

On the coil component 1000 pertaining to the comparative example, the lead conductor 51 connected to the end part 34 of the flat coil 30 is led out, through the interior of the base part 10, from the inner side of the flat coil 30 to the outer side of the flat coil 30. As a result, the lead conductor 51 intersects all windings of the coil conductor 32. This way, magnetic flux generated by the current flowing through the lead conductor 51 passes through the parts of the coil conductor 32 that intersect the lead conductor 51, and consequently eddy current generates in the coil conductor 32. This is explained using FIG. 5.

Figure 5:
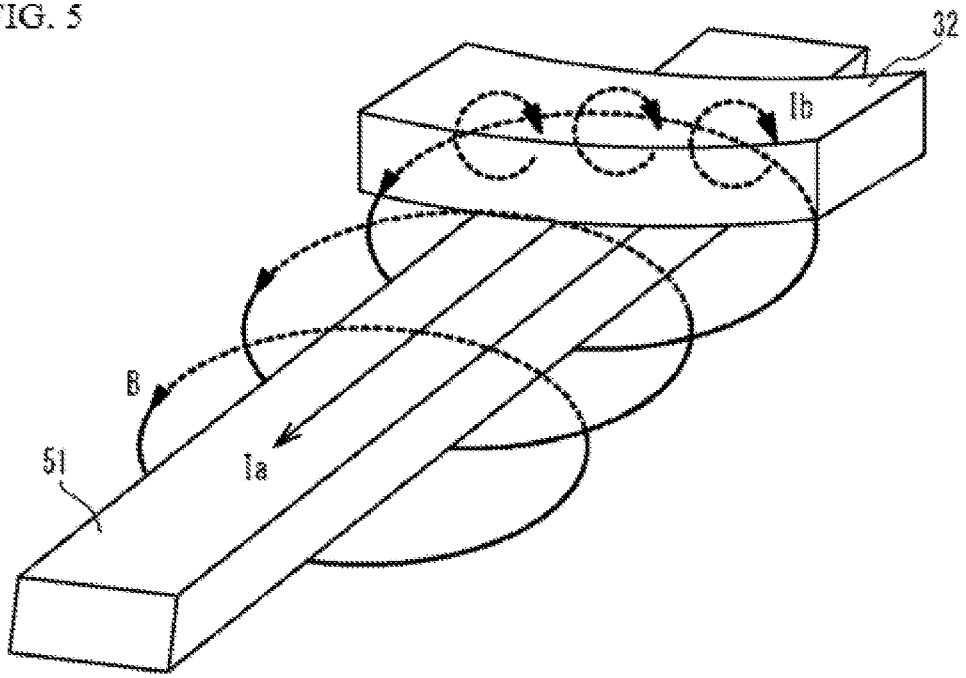
FIG. 5 is a drawing provided to explain the problems that occur in the coil component pertaining to the comparative example.

FIG. 5 is a drawing provided to explain the problems that occur in the coil component pertaining to the comparative example. It should be noted that, in FIG. 5, only one of the multiple windings of the coil conductor 32 that intersect the lead conductor 51 is illustrated for the sake of illustrative clarity. As shown in FIG. 5, magnetic flux B generates when current Ia flows through the lead conductor 51. Since current Ia flows under repeated on/off cycles, magnetic flux B changes with every increase/decrease in current Ia. As it is led out, the lead conductor 51 intersects the coil conductor 32, which means magnetic flux B generating around the lead conductor 51 transmits through the coil conductor 32. As magnetic flux B transmitting through the coil conductor 32 changes, spiral inductive current, or eddy current Ib to be specific, generates in the coil conductor 32. Generation of eddy current Ib in the coil conductor 32 causes energy loss due to the electrical resistance of the coil conductor 32; in other words, eddy current increases loss inside the coil conductor 32. The higher the frequency band where coil parts are used becomes, the faster magnetic flux B generating around the lead conductor 51 changes, since current Ia flowing through the lead conductor 51 switches on/off quickly. Therefore, eddy current generating in the coil conductor 32 increases loss inside the coil conductor 32. Conversely, magnetic flux generating in the coil conductor 32 transmits through the lead conductor 51, and this also increases loss due to eddy current inside the lead conductor 51. It should be noted that loss due to eddy current occurs inside the conductor at all parts where the lead conductor 51 intersects the multiple windings of the coil conductor 32, on both the lead conductor 51 side and the coil conductor 32 side.

According to Example 1, on the other hand, the lead conductor 50 is connected to the external electrode 60 in the area 42 on the inner side of the flat coil 30 when the base part 10 and the flat coil 30 are viewed from above in the direction of the coil axis 38 of the flat coil 30, as shown in FIG. 1 and FIG. 2A. This way, the parts of the lead conductor 50 that intersect the coil conductor 32 can be decreased. This reduces eddy current that generates as a result of the transmission, through the coil conductor 32, of magnetic flux generating in the lead conductor 50, and also as a result of the transmission, through the lead conductor 50, of magnetic flux generating in the coil conductor 32, the consequence of which is a suppression in the increase in loss due to eddy current inside the conductor.

Preferably the lead conductor 50 connects the edge part 34 of the flat coil 30 and the external electrode 60 provided on the bottom face 12 of the base part 10, along a straight line. This way, eddy current generating in the coil conductor 32 and lead conductor 50 can be reduced effectively. Also, the electrical resistance of the lead conductor 50 can be made smaller.

Preferably the lead conductor 50 connects the end part 34 of the flat coil 30 and the external electrode 60 provided on the bottom face 12 of the base part 10, along a straight line in parallel with the coil axis 38 of the flat coil 30, as shown in FIG. 3A. This prevents the lead conductor 50 from intersecting the coil conductor 32, and consequently eddy current generating in the coil conductor 32 and lead conductor 50 can be reduced more effectively. Also, the length of the lead conductor 50 becomes short, and thus its electrical resistance becomes smaller; in this sense, too, the impact of eddy current can be suppressed.

Preferably the lead conductor 50 is provided in a manner overlapping the coil conductor 32 when the base part 10 and the flat coil 30 are viewed from above in the direction of the coil axis 38, as shown in FIG. 3A. This ensures good connection stability between the lead conductor 50 and the coil conductor 32, allowing the connection resistance to remain constant regardless of any position deviation of the connection part.

As shown in FIG. 1 and FIG. 3A, preferably the lead conductor 52 connects the end part 36 of the flat coil 30 and the external electrode 62 provided on the bottom face 12 of the base part 10. The external electrodes 60 and 62 are provided on the bottom face 12, but not on the top face 14, of the base part 10. This way, the coil component 100 can be made thinner. More preferably the external electrodes 60 and 62 are provided only on the bottom face 12 among all surfaces, and not on any other face but the bottom face 12, of the base part 10. This prevents the solder from attaching to the end faces 16*a* and 16*b* or the side faces 18*a* and 18*b* of the base part 10 when the coil component 100 is mounted on a circuit board, which allows for high-density mounting, in addition to thickness reduction, of the coil component 100.

As shown in FIG. 2B, preferably the cross-section shapes of the lead conductors 50 and 52 in the direction perpendicular to the coil axis 38 are a circle. This way, magnetic flux generating in the coil conductor 32 and transmitting through the lead conductors 50 and 52 can be kept virtually constant, even when the positions at which the lead conductors 50 and 52 are formed change according to the winding condition of the coil conductor 32, and consequently loss occurring in the lead conductors 50 and 52 due to eddy current generating in the lead conductors 50 and 52 can be kept constant. In addition, preferably the width of the coil conductor 32 is greater than the spacing between the conductive windings of the coil conductor 32, while the width of the coil conductor 32 is also greater than the height of the coil conductor 32. This way, even when a magnetic material exists, in a manner penetrating in the direction of the coil axis 38, in the spacing parts between the conductive windings of the coil conductor 32, or specifically the area overlapping the flat coil 30 as viewed in the direction of the coil axis 38, eddy current generating between these parts of the coil conductor 32 can still be reduced.

As shown in FIG. 2B, preferably the external electrodes 60 and 62 are provided symmetrically to the center line 20 and/or the center 22 of the bottom face 12 of the base part 10. This way, the coil component 100 can be mounted on a circuit board, etc., in a well-balanced manner. Also, the distance between the external electrodes 60 and 62 is preferably 100 μm or greater, or more preferably 150 μm or greater, or even more preferably 200 μm or greater, for example, from the viewpoints of suppressing short-circuiting, ease of manufacturing, etc.

Figure 6A:
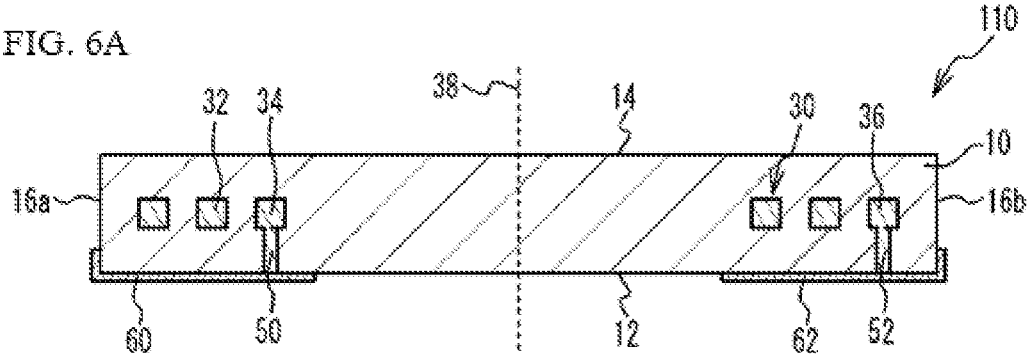
FIGS. 6A to 6C are cross-sectional views of the coil components pertaining to Variation Example 1 to Variation Example 3 of Example 1.
Figure 6B:
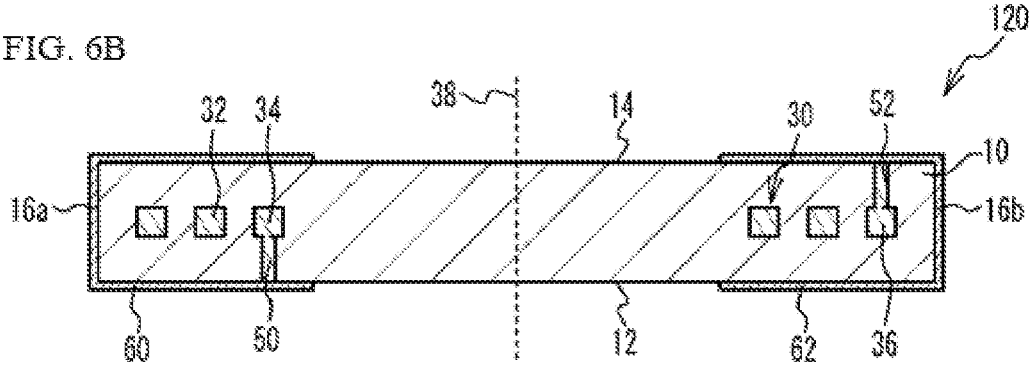
Figure 6C:
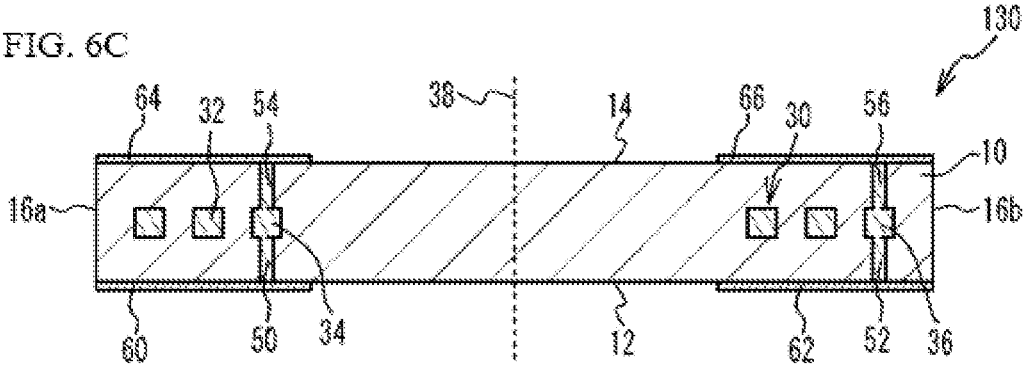

FIG. 6A to FIG. 6C are cross-sectional views of a coil components pertaining to Variation Example 1 to Variation Example 3 of Example 1. As shown in FIG. 6A, a coil component 110 in Variation Example 1 of Example 1 is such that the external electrodes 60 and 62 extend from the bottom face 12, to the end faces 16*a* and 16*b*, of the base part 10. The remaining constitutions are the same as those in Example 1 and therefore not explained. Because the external electrodes 60 and 62 extend to the end faces 16*a* and 16*b* of the base part 10, as shown in Variation Example 1 of Example 1, solder filets are formed at the external electrodes 60 and 62 provided on the end faces 16*a* and 16*b* of the base part 10 when the coil component 110 is joined to a circuit board using solder. This can improve the joining strength between the coil component 110 and the circuit board.

As shown in FIG. 6B, a coil component 120 in Variation Example 2 of Example 1 is configured so that the lead conductor 50 is led out from the end part 34 of the flat coil 30 to the bottom face 12 of the base part 10, and connects to the external electrode 60 on the bottom face 12. The lead conductor 52 is led out from the end part 36 of the flat coil 30 to the top face 14 of the base part 10, and connects to the external electrode 62 on the top face 14. The external electrode 60 extends from the bottom face 12, via the end face 16*a*, to the top face 14, of the base part 10, while the external electrode 62 extends from the bottom face 12, via the end face 16*b*, to the top face 14, of the base part 10. In other words, the external electrodes 60 and 62 are three-face electrodes. It should be noted that the external electrodes 60 and 62 may also be five-face electrodes that extend to the side faces 18*a* and 18*b*, as well. Also, the lead conductor 52 may extend from the end part 36 of the flat coil 30 to the bottom face 12 of the base part 10, and connect to the external electrode 62 on the bottom face 12. The remaining constitutions are the same as those in Example 1 and therefore not explained.

According to Variation Example 2 of Example 1, the external electrode 60 connected to the lead conductor 50 is provided in a manner extending from the bottom face 12, via the end face 16*a*, to the top face 14, of the base part 10. The external electrode 62 connected to the lead conductor 52 is provided in a manner extending from the bottom face 12, via the end face 16*b*, to the top face 14, of the base part 10. This way, both the bottom face 12 and the top face 14 of the base part 10 can be used as a mounting face.

As shown in FIG. 6C, a coil component 130 in Variation Example 3 of Example 1 is configured so that, in addition to the lead conductor 50, a lead conductor 54 is also connected to the end part 34 of the flat coil 30. The lead conductor 54 is present only inside the area 42 (refer to FIG. 2A) when viewed from above in the direction of the coil axis 38, and connects the end part 34 of the flat coil 30 and an external electrode 64 provided on the top face 14 of the base part 10. In addition to the lead conductor 52, a lead conductor 56 is also connected to the end part 36 of the flat coil 30. The lead conductor 56 connects the end part 36 of the flat coil 30 and an external electrode 66 provided on the top face 14 of the base part 10. The remaining constitutions are the same as those in Example 1 and therefore not explained.

According to Variation Example 3 of Example 1, the lead conductors 50 and 54 are connected to the end part 34, while the lead conductors 52 and 56 are connected to the end part 36, of the flat coil 30. When the base part 10 and flat coil 30 are viewed from above in the direction of the coil axis 38 of the flat coil 30, the lead conductor 50 is connected, in the area 42 on the inner side of the flat coil 30, to the external electrode 60 provided on the bottom face 12 of the base part 10, while the lead conductor 54 is connected, in the area 42 on the inner side of the same, to the external electrode 64 provided on the top face 14 of the base part 10. Also, the lead conductor 52 is connected to the external electrode 62 provided on the bottom face 12 of the base part 10, while the lead conductor 56 is connected to the external electrode 66 provided on the top face 14 of the base part 10. This way, both the bottom face 12 and the top face 14 of the base part 10 can be used as a mounting face.

Preferably the external electrodes 60, 62, 64, and 66 are provided on the bottom face 12 and the top face 14, and not on any face other than the bottom face 12 and the top face 14, of the base part 10. This allows for high-density mounting for the same reasons explained in Example 1. It should be noted that, also in Variation Example 3 of Example 1, the external electrodes provided on the surface of the base part 10 may be three-face electrodes or five-face electrodes, just like in Variation Example 2 of Example 1. In other words, the external electrode 60 provided on the bottom face 12 of the base part 10 and the external electrode 64 provided on the top face 14 of the same may be connected on the end face 16*a*, while the external electrode 62 provided on the bottom face 12 of the base part 10 and the external electrode 66 provided on the top face 14 of the same may be connected on the end face 16*b*.

Example 2

Figure 7:
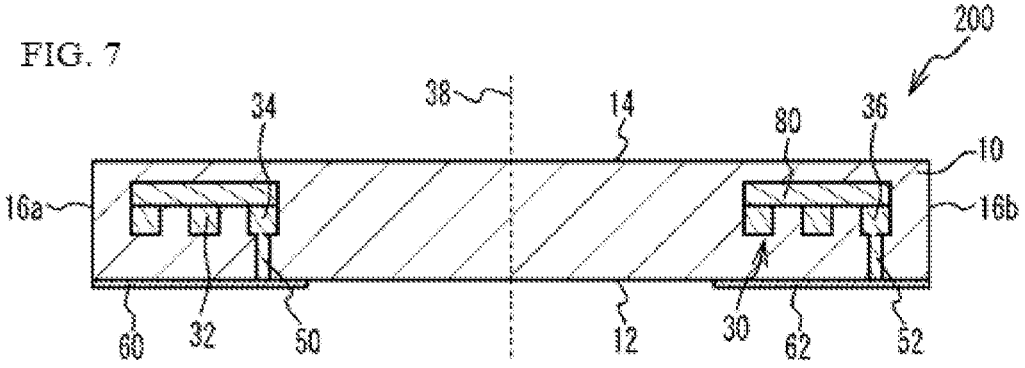
FIG. 7 is a cross-sectional view of the coil component pertaining to Example 2.

FIG. 7 is a cross-sectional view of a coil component pertaining to Example 2. As shown in FIG. 7, a coil component 200 in Example 2 is configured so that a board 80 having the coil conductor 32 formed on its principle face is embedded in the base part 10. The remaining constitutions are the same as those in Example 1 and therefore not explained. The coil component 200 in Example 2 is manufactured according to the following method, for example. First, the coil conductor 32 is formed on the principle face of the board 80, which is a glass board or other insulating board, using the plating method, for example. Then, the base part 10 is formed on both principle faces of the board 80 on which the coil conductor 32 has been formed, using the lamination method, hydrostatic press method, etc., for example. This way, the base part 10 with the built-in board 80 having the coil conductor 32 is obtained. Next, the bottom face 12 of the base part 10 is lasered, etched, or otherwise processed to form holes through which both of the end parts 34 and 36 of the flat coil 30 would be exposed, after which a conductive material is filled in these holes using the printing method, etc., for example, to form the lead conductors 50 and 52. Thereafter, the external electrodes 60 and 62 are formed on the bottom face 12 of the base part 10.

As with the coil component 200 in Example 2, the board 80 having the coil conductor 32 formed on its principle face may be embedded in the base part 10. In this case, presence of the board 80 on the top face of the coil conductor 32 means absence of magnetic material over the entire top face of the flat coil 30. In other words, no magnetic material is present that penetrates through the area overlapping the flat coil 30 as viewed in the direction of the coil axis 38. As a result, generation of eddy current in the coil conductor 32 can be suppressed effectively.

Example 3

Figure 8:
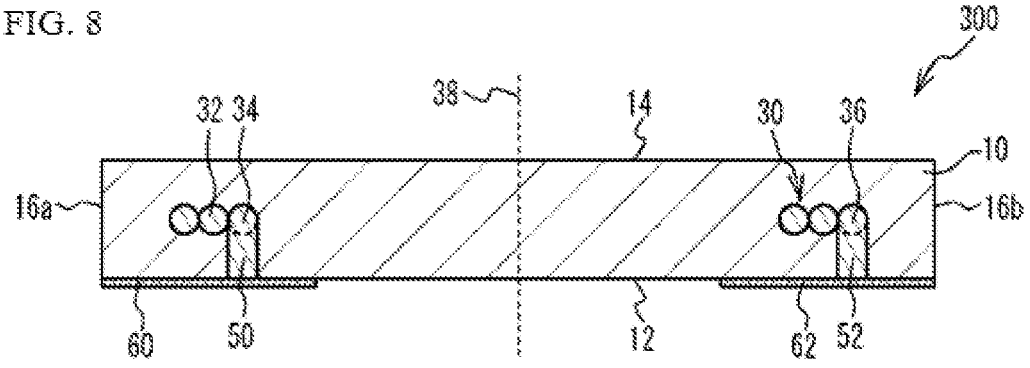
FIG. 8 is a cross-sectional view of the coil component pertaining to Example 3.

FIG. 8 is a cross-sectional view of a coil component pertaining to Example 3. As shown in FIG. 8, a coil component 300 in Example 3 is configured so that the coil conductor 32 is constituted by a sheathed conductive wire, and its cross-section shape is a circle. The lead conductors 50 and 52 are formed by bending the conductive wire from which the coil conductor 32 has been formed. In other words, the coil conductor 32, and the lead conductors 50 and 52, have the same diameter and cross-section shape. The remaining constitutions are the same as those in Example 1 and therefore not explained. The coil component 300 in Example 3 is manufactured according to the following method, for example. First, a sheathed conductive wire is wound to form the coil conductor 32, while at the same time both end part sides of the wound conductive wire are bent into the lead conductors 50 and 52. Then, the base part 10 in which the coil conductor 32 and the lead conductors 50 and 52 are built, is formed using the lamination method, hydrostatic press method, etc. At this time, the end faces of the lead conductors 50 and 52 are exposed from the bottom face 12 of the base part 10. Thereafter, the external electrodes 60 and 62 are formed on the bottom face 12 of the base part 10.

As with the coil component 300 in Example 3, the lead conductors 50 and 52 may be formed by bending the conductive wire from which the coil conductor 32 has been formed. In this case, no magnetic material is present between the parts of the coil conductor 32. In other words, on a section perpendicular to the direction of the coil axis 38, no magnetic material is present that penetrates between the conductive windings of the flat coil 30 in the direction parallel with the coil axis 38. As a result, generation of eddy current in the coil conductor 32 can be suppressed effectively. It should be noted that the conductive wire is not limited to a round wire of which cross-section shape is a circle, and it may also be a rectangular wire of which cross-section shape is a rectangle.

Example 4

Figure 9:
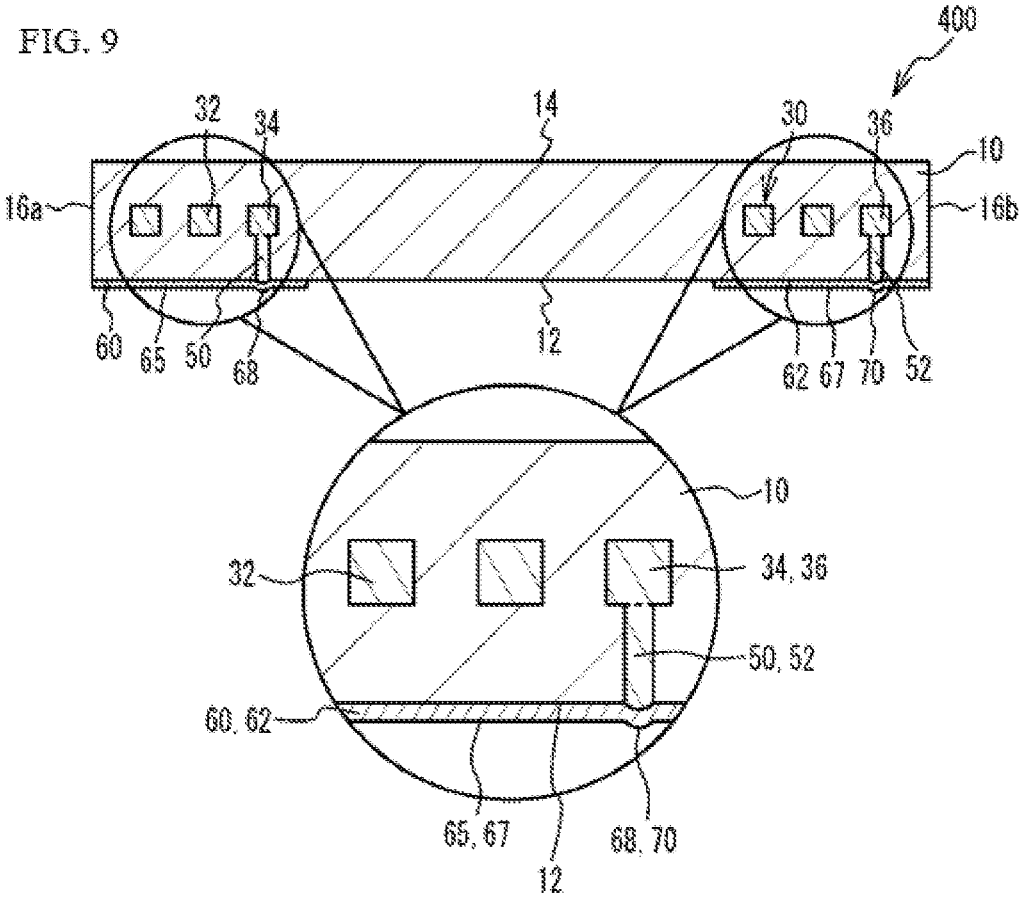
FIG. 9 is a cross-sectional view of the coil component pertaining to Example 4.

FIG. 9 is a cross-sectional view of a coil component pertaining to Example 4. As shown in FIG. 9, a coil component 400 in Example 4 is configured so that the end parts of the lead conductors 50 and 52 project from the bottom face 12 of the base part 10. The amounts by which the lead conductors 50 and 52 project from the bottom face 12 of the base part 10 are approx. 5 μm to 20 μm, for example. The external electrode 60 is formed in a manner covering the end part of the lead conductor 50 projecting from the bottom face 12 of the base part 10, and a projection 68 that rises in a dome shape is formed as a result. In other words, the external electrode 60 has a face 65 roughly parallel with the bottom face 12 of the base part 10, and the dome-shaped projection 68 that rises, with reference to this roughly parallel face 65, toward the opposite side of the bottom face 12 of the base part 10. Similarly, the external electrode 62 is formed in a manner covering the end part of the lead conductor 52 projecting from the bottom face 12 of the base part 10, and a projection 70 that rises in a dome shape is formed as a result. In other words, the external electrode 62 has a face 67 roughly parallel with the bottom face 12 of the base part 10, and the dome-shaped projection 70 that rises, with reference to this roughly parallel face 67, toward the opposite side of the bottom face 12 of the base part 10. It should be noted that the "roughly parallel face" mentioned here does not only mean "parallel" in the strict sense, but also accommodates a slight inclination, etc., equivalent to a manufacturing error. It should also be noted that the "dome-shaped projection" refers to a projection of which shape is such that the projected height is lower in the area on the outer periphery side of the projection, with the projected height increasing toward the center part of the projection. The remaining constitutions are the same as those in Example 1 and therefore not explained.

The coil component 400 in Example 4 can be formed by a method similar to the manufacturing method explained in Example 1, for example. Here, a structure where the end parts of the lead conductors 50 and 52 project from the bottom face 12 of the base part 10 can be obtained by using, for the conductive material with which to form the lead conductors 50 and 52, a material that shrinks less, when sintered, than does the insulating material with which to form the base part 10.

According to Example 4, the end parts of the lead conductors 50 and 52 project from the bottom face 12 of the base part 10. The external electrodes 60 and 62 cover the end parts of the lead conductors 50 and 52 projecting from the bottom face 12 of the base part 10, and thereby form the dome-shaped projections 68 and 70. As a result, pressing the external electrodes 60 and 62 onto the solder applied on a circuit board for the purpose of mounting them on the circuit board, causes the projections 68 and 70 to bite into the solder. This prevents the coil component 400 from deviating from its specified position even when, for example, vibration that generates when the pickup device is raised by breaking the vacuum, or vibration that generates when the circuit board is transferred to the melting furnace, is applied to the coil component 400.

Example 5

Figure 10:
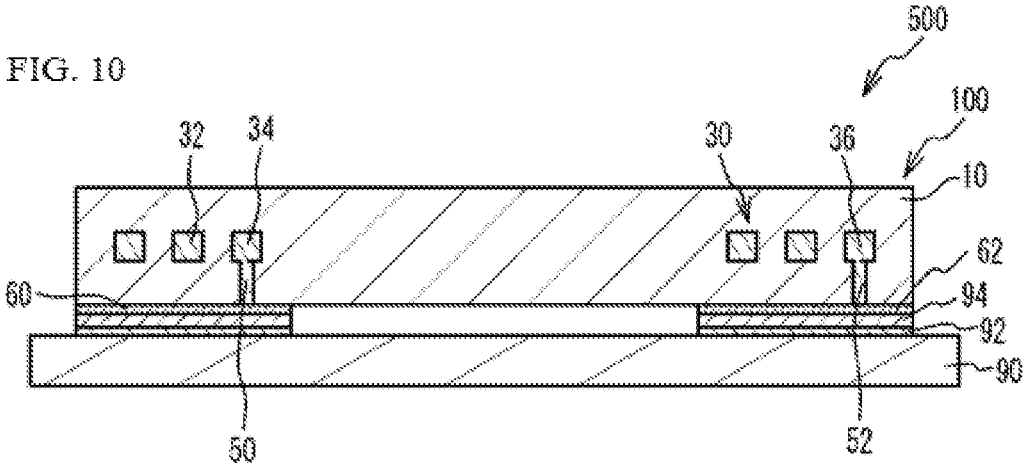
FIG. 10 is a cross-sectional view of the electronic device pertaining to Example 5.

FIG. 10 is a cross-sectional view of an electronic device pertaining to Example 5. As shown in FIG. 10, the electronic device 500 in Example 5 has a circuit board 90, and the coil component 100 in Example 1 mounted on the circuit board 90. The coil component 100 is mounted on the circuit board 90 by joining its external electrodes 60 and 62 to land patterns 92 on the circuit board 90 using solder 94.

It should be noted that, while Example 5 presents an example where the coil component 100 in Example 1 is mounted on the circuit board 90, any of the coil components in Variation Example 1 of Example 1 to Example 4 may be mounted on the circuit board 90. When the coil component 400 in Example 4 is mounted on the circuit board 90, for example, position deviation problems can be prevented at the time of mounting the coil component 400 on the circuit board 90, as explained in Example 4. Also, the coil component may be embedded in the circuit board 90, and it can be made thinner in either case.

The foregoing described the examples of the present invention in detail; it should be noted, however, that the present invention is not limited to these specific examples, and various modifications/changes may be added to the extent that the results do not deviate from the key points of the present invention as described in "What Is Claimed Is.

We claim:

1. A coil component comprising:

a base part containing a magnetic material and having insulating property;

a flat coil embedded in the base part, formed by a wound coil conductor where one end part referred to as a first end part is located on an inner side of the windings, and another end part referred to as a second end part is located on an outer side of the windings;

a first lead conductor connected to the first end part of the flat coil;

a second lead conductor connected to the second end part of the flat coil;

a first external electrode provided on a surface of the base part at one end of the base part, and connected to the first lead conductor; and a second external electrode provided on a surface of the base part at another end of the base part opposite to the one end, and connected to the second lead conductor;

wherein the first lead conductor is connected to the first external electrode in an area on an inner side of an outermost periphery coil conductor of the flat coil when the base part and the flat coil are viewed from above in a direction of a coil axis of the flat coil, the first external electrode and the second external electrode are provided symmetrically with respect to a center line defining a midpoint between the one end and the another end of the base part, or symmetrically with respect to a center point of the center line, and the flat coil has a shape, as an outer periphery of the flat coil when viewed in the direction of the coil axis, defined by a ratio of a long axis length L1 and a short axis length L2 of the flat coil, and the base part has a shape, as an outer periphery of the base part when viewed in the direction of the coil axis, defined by a ratio of a long direction length L3 and a short direction length L4 of the base part, wherein L2/L1≅L4/L3.

2. The coil component according to claim 1, wherein the first lead conductor is connected from the first end part of the flat coil to the first external electrode, along a straight line.

3. The coil component according to claim 2, wherein the first lead conductor is parallel with the coil axis.

4. The coil component according to claim 3, wherein the first lead conductor overlaps the coil conductor when the base part and the flat coil are viewed from above in the direction of the coil axis.

5. The coil component according to claim 1, wherein a cross-sections of the first lead conductor and the second lead conductor, in a direction perpendicular to the coil axis, have a circular shape.

6. The coil component according to claim 1, wherein:

the first lead conductor connects to the first external electrode provided on a first face, among all surfaces, of the base part;

the second lead conductor connects to the second external electrode provided on the first face of the base part; and the first external electrode and the second external electrode are not provided on a second face, on an opposite side of the first face, of the base part.

7. The coil component according to claim 6, wherein the first external electrode and the second external electrode are provided only on the first face, among all surfaces, of the base part.

8. The coil component according to claim 1, wherein:

the first external electrode is provided in a manner extending from a first face among all surfaces, via a third face that connects to the first face and a second face on the opposite side of the first face, to the second face, of the base part; and the second external electrode is provided in a manner extending from the first face, via a fourth face that connects to the first face and the second face, to the second face, of the base part.

9. A coil component comprising:

a base part containing a magnetic material and having insulating property;

a flat coil embedded in the base part, formed by a wound coil conductor where one end part referred to as a first end part is located on an inner side of the windings, and another end part referred to as a second end part is located on an outer side of the windings;

a first lead conductor connected to the first end part of the flat coil;

a second lead conductor connected to the second end part of the flat coil;

a first external electrode provided on a surface of the base part and connected to the first lead conductor; and a second external electrode provided on a surface of the base part and connected to the second lead conductor;

wherein the first lead conductor is connected to the first external electrode in an area on an inner side of an outermost periphery coil conductor of the flat coil when the base part and the flat coil are viewed from above in a direction of a coil axis of the flat coil, said coil component further comprising:

a third lead conductor connected to the first end part of the flat coil;

a fourth lead conductor connected to the second end part of the flat coil;

a third external electrode provided on a surface of the base part and connected to the third lead conductor; and a fourth external electrode provided on a surface of the base part and connected to the fourth lead conductor;

wherein the first lead conductor is connected to the first external electrode provided on a first face, among all surfaces, of the base part;

the second lead conductor is connected to the second external electrode provided on the first face of the base part;

the third lead conductor is connected to the third external electrode provided on a second face, on an opposite side of the first face, of the base part, in an area on the inner side of the outermost periphery coil conductor of the flat coil, when the base part and the flat coil are viewed from above in the direction of the coil axis; and the fourth lead conductor is connected to the fourth external electrode provided on the second face of the base part.

10. The coil component according to claim 9, wherein:

the first external electrode and the third external electrode are connected on a third face that connects to the first face and the second face of the base part; and the second external electrode and the fourth external electrode are connected on a fourth face that connects to the first face and the second face of the base part.

11. A coil component comprising:

a base part containing a magnetic material and having insulating property;

a flat coil embedded in the base part, formed by a wound coil conductor where one end part referred to as a first end part is located on an inner side of the windings, and another end part referred to as a second end part is located on an outer side of the windings;

a first lead conductor connected to the first end part of the flat coil;

a second lead conductor connected to the second end part of the flat coil;

a first external electrode provided on a surface of the base part and connected to the first lead conductor; and a second external electrode provided on a surface of the base part and connected to the second lead conductor;

wherein the first lead conductor is connected to the first external electrode in an area on an inner side of an outermost periphery coil conductor of the flat coil when the base part and the flat coil are viewed from above in a direction of a coil axis of the flat coil, wherein:

the first lead conductor is connected to the first external electrode provided on a first face, among all surfaces, of the base part;

the second lead conductor is connected to the second external electrode provided on the first face of the base part;

end parts of the first lead conductor and the second lead conductor project from the first face of the base part; and the first external electrode and the second external electrode cover the end parts of the first lead conductor and the second lead conductor to form dome-shaped projections.

12. The coil component according to claim 1, wherein the height of the coil component is 0.6 mm or smaller.

13. An electronic device comprising:

the coil component according to claim 1; and a circuit board which the coil component is mounted on or embedded in.

* * * * *